US005201963A

United States Patent [19]

Mukai et al.

[11] Patent Number: 5,201,963

[45] Date of Patent: Apr. 13, 1993

[54] RARE EARTH MAGNETS AND METHOD OF PRODUCING SAME

[75] Inventors: Toshio Mukai; Tatsuo Fujimoto; Toru Inaguma, all of Kawasaki City, Japan

[73] Assignee: Nippon Steel Corporation, Tokyo, Japan

[21] Appl. No.: 800,712

[22] Filed: Dec. 4, 1991

Related U.S. Application Data

[62] Division of Ser. No. 603,993, Oct. 26, 1990, abandoned.

[30] Foreign Application Priority Data

Oct. 26, 1989 [JP] Japan ..... 1-279483

[51] Int. Cl.[5] ..... H01F 1/02

[52] U.S. Cl. ..... 148/104; 419/12; 419/29; 148/101

[58] Field of Search ..... 148/101, 102, 104; 419/12, 24

[56] References Cited

U.S. PATENT DOCUMENTS

| | | | |
|---|---|---|---|
| 4,756,775 | 7/1988 | Croat | 148/302 |
| 4,792,367 | 12/1988 | Lee | 148/104 |
| 4,981,532 | 1/1991 | Takeshita et al. | 148/302 |
| 4,985,086 | 1/1991 | Iwasaki et al. | 148/101 |
| 4,995,905 | 2/1991 | Sagawa | 75/244 |

FOREIGN PATENT DOCUMENTS

| | | | |
|---|---|---|---|
| 0106948 | 5/1984 | European Pat. Off. | 148/302 |
| 0311049 | 4/1989 | European Pat. Off. | 148/302 |
| 60-100402 | 6/1985 | Japan . | |
| 60-254708 | 12/1985 | Japan | 419/29 |
| 61-34242 | 8/1986 | Japan . | |
| 2-39503 | 2/1990 | Japan | 148/301 |

OTHER PUBLICATIONS

Lee, Appl. Phys. Lett. 46(8), p. 790–791 (1985).

Nozawa et al., J. Appl. Phys. 64(10), pp. 5285–5289 (1988).

*Primary Examiner*—John P. Sheehan

*Attorney, Agent, or Firm*—Wenderoth, Lind & Ponack

[57] ABSTRACT

Rare earth magnets comprising 12 to 20 at % R (where R denotes rare earth elements including at least one selected from neodymium and praseodymium) and 2 to 10 at % boron, with the remainder being TM (where $TM=Fe_{1-x}Co_x$ ($0 \leqq x \leqq 0.4$)) and unavoidable impurities, wherein 50 to 100 vol % of the magnet is formed of recrystallization grains of $R_2Fe_{14}B$ intermetallic compound having a tetragonal crystal structure with an average grain size of 1 to 100 μm and an induced anisotropy P of 0.1 or more (where $P=(Br(\parallel)-Br(\perp))/(Br(\parallel)+Br(\perp))$, $Br(\parallel)$ being residual magnetic flux density along the easy magnetization axis and $Br(\perp)$ being residual magnetic flux density perpendicular to the easy magnetization axis), and the method of producing the rare earth magnets.

4 Claims, 8 Drawing Sheets (a) As-pressed
Nd16 Fe77.5 B5 Cu1.5
(∥)
(⊥)
4πI (kG)
H (kOe)

(b) 1000°C · 10min
(∥)
(⊥)
4πI (kG)
H (kOe)

(c) 1000°C · 10min
+
600°C · 10min
(∥)
(⊥)
4πI (kG)
H (kOe)

FIG. 8(a)
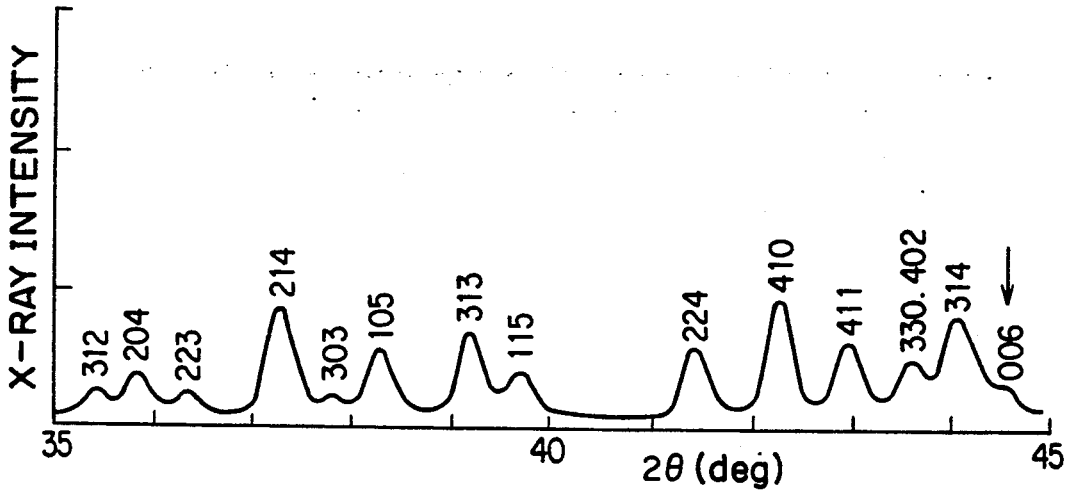
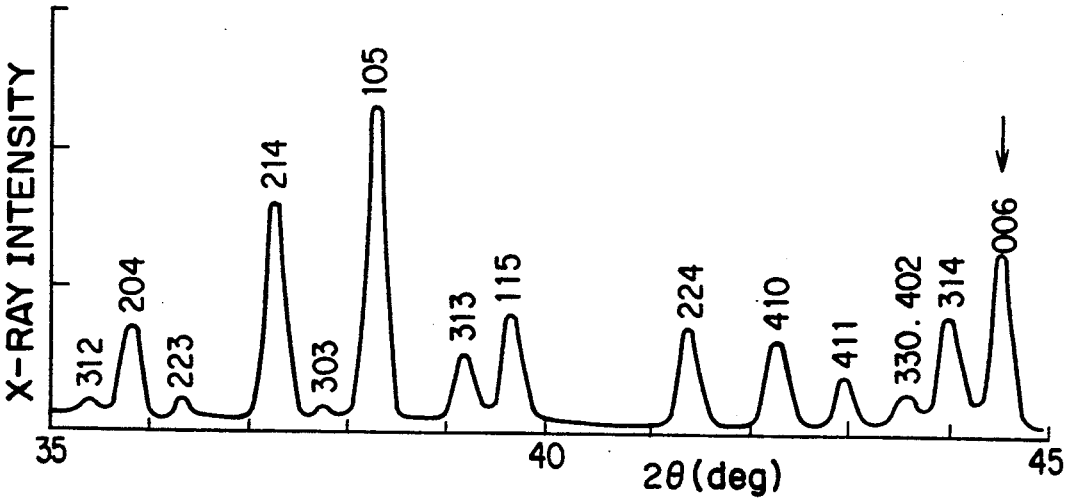
FIG. 8(b)

RARE EARTH MAGNETS AND METHOD OF PRODUCING SAME

This application is a division of now abandoned application. Ser. No. 0-7/603,993 filed Oct. 26, 1990, now abandoned.

BACKGROUND OF THE INVENTION

1. Field of the Invention

The present invention relates to rare earth magnets and a method of producing the rare earth magnets in which the main phase is $R_2Fe_{14}B$, where R is at least one rare earth selected from neodymium and praseodymium.

2. Description of the Prior Art

Rapid-quenched ribbons with good magnetic properties can be obtained by using a single-roll technique to rapidly cool an alloy melt containing rare earth R and representative transition metallic elements iron and boron in a ratio of substantially 2:14:1 (U.S. Pat. No. 4 756 775). Ribbons about 30 μm thick are obtained by a single-roll rapid-quenching technique in which the melt of a Nd-Fe-B system alloy is ejected onto the peripheral surface of a rotating copper roll. The cooling conditions can be varied to achieve ribbon with a fine-grained microstructure with a grain size of 0.01 to 0.5 μm.

The rapid-quenched Nd-Fe-B alloy thus obtained can then be ground into powder and consolidated nearly to full density by hot-pressing. This is reported in U.S. Pat. No. 4 792 367, JP-A-60-100402, and "Hot-pressed neodymium-iron-boron magnets" by R. W. Lee (Applied Physics Letters, vol. 46, No. 8, pp 790–791, Apr. 15, 1985). The hot-pressed bodies thus formed have yielded a residual magnetic flux density of around 8 kG.

To obtain a higher residual magnetic flux density it is necessary to induce anisotropy in the magnets. In his paper Lee proposed the use of plastic deformation to induce anisotropy. In this method hot-pressing is used to consolidate Nd-Fe-B powder to almost full density, and die-upsetting is then used to achieve plastic deformation of the pressed body. With this method, residual magnetic flux densities of 8 to 13 kG have been reported (for example, by Nozawa et al in J. Appl. Phys., Vol. 64, No. 10, pp 5285–5289, Nov. 15, 1988), depending on die-upsetting conditions and the composition of the alloy.

While magnets with high coercive force can thus be obtained by hot-deformation, a problem is that it involves a lengthy manufacturing process and factors such as surface cracking occurring during the plastic deformation make it difficult to form the magnets into product shapes.

Anisotropic sintered magnets are produced by grinding alloy ingots to obtain powder having a particle size smaller than the grain size, for example 3 μm. The powder is then aligned in a magnetic field, cold-pressed and sintered. This method has provided Nd-Fe-B sintered magnets with good magnetic properties (cf JP-B-61-34242). However, the fact that this method involves the handling of highly active fine powder presents manufacturing problems. Also, the sintering is a conventional atmospheric pressure process that can give rise to dimensional changes and shape deformation, making it necessary to apply some post-machining to achieve the requisite product shape.

SUMMARY OF THE INVENTION

An object of the present invention is to provide magnets made from rapid-quenched Nd-Fe-B system alloy powder having a high residual magnetic flux density arising from anisotropy induced by heat-treatment alone.

Another object of the present invention is to provide a method of producing rare earth magnets which eliminates the need for shaping and grinding the formed magnets.

BRIEF DESCRIPTION OF THE DRAWINGS

The objects and features of the present invention will become more apparent from a consideration of the following detailed description taken in conjunction with the accompanying drawings in which:

FIGS. 8(*a*) and 8(*b*) show x-ray diffraction intensity profiles of pressed bodies, (a) prior to recrystallization heat-treatment and (b) after recrystallization heat-treatment.

DETAILED DESCRIPTION OF THE INVENTION

The rare earth magnets produced in accordance with the present invention comprise 12 to 20 at % R (where R denotes rare earth elements including at least one selected from neodymium and praseodymium) and 2 to 10 at % on, with the remainder being TM (where $TM=Fe_{1-x}Co_x$ ($0 \leqq x \leqq 0.4$)) and unavoidable impurities, wherein 50 to 100 vol % of the rare earth magnets is constituted of recrystallization grains of $R_2Fe_{14}B$ intermetallic compound having a tetragonal crystal structure with an average grain size of 1 to 100 μm and an induced anisotropy P of 0.1 or more (where $P=(Br(\|)-Br(\perp))/(Br(\|)+Br(\perp))$, Br(||) being residual magnetic flux density along the easy magnetization axis and Br(⊥) being residual magnetic flux density perpendicular to the easy magnetization axis).

The present invention also comprises a method of producing the rare earth magnets comprising the steps of using rapid-quenching to form an alloy powder having a composition within the above range, hot-pressing to obtain a pressed body from the powder by consolidating the powder to 90 % or more of full density, heating the pressed body at 750° C. to 1150° C. and optionally following this by aging at 450° C. to 750° C.

The rare earth magnets can be produced with good efficiency by a heating technique which involves passing a current through the powder under pressure. Higher coercive force is achieved by adding up to 5 at % copper and/or substituting dysprosium for up to 20 at % of the total R content.

This fine-grained Nd-Fe-B powder obtained from rapid-quenched ribbon material can be readily consolidated nearly to full density by hot-pressing at 600° C. to 900° C. The pressed body thus obtained substantially is magnetically isotropic. The present inventors found that anisotropy could be induced in the pressed bodies by the supplementary application of appropriate heat-treatment to recrystallize the fine-grained structure.

Figures 1A, 1B, 1C:
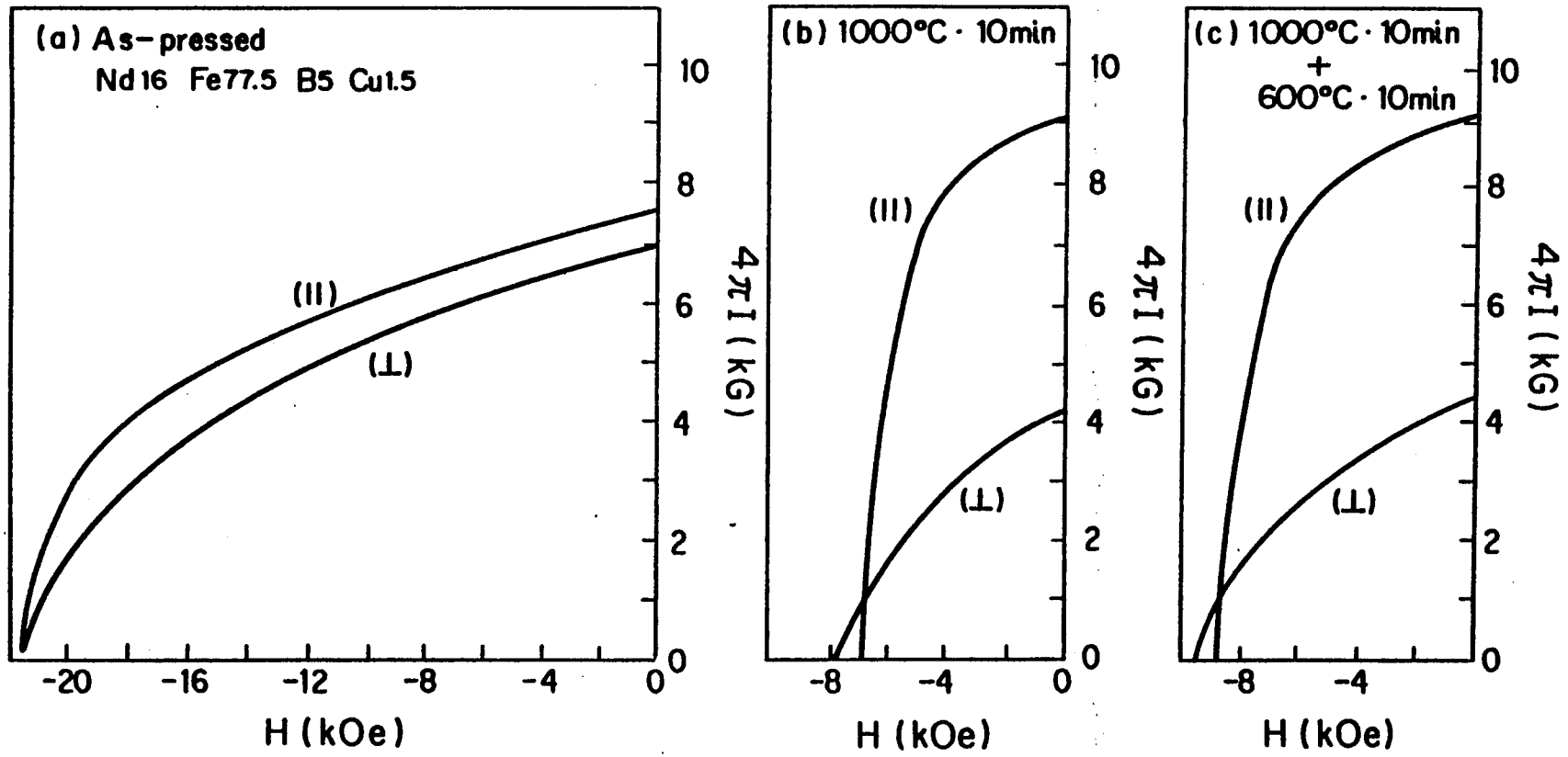
FIGS. 1(*a*) to 1(*c*) is a set of demagnetization curves showing changes in the residual magnetic flux density of hot-pressed bodies measured in the press direction Br(||) and perpendicular to the press direction Br(⊥), (a) prior to heat-treatment, (b) after recrystallization heat-treatment and (c) after aging.

The present invention will now be described in detail. The rapid-quenched powder having a composition, in atomic percent, of 77.5% Fe−16% Nd−5% B−1.5% Cu (hereinafter denoted as "$Nd_{16}Fe_{77.5}B_5Cu_{1.5}$") can be readily consolidated by passing an electric current through the powder under pressure. FIG. 1 (*a*) shows demagnetization curves of pressed bodies measured in the press direction ( || ) and in the direction (⊥) perpendicular to the press direction. The nearly perfect isotropy is indicated by the fact that there is little difference between residual magnetic flux densities in the two directions. After being heated to 1000° C. to induce recrystallization, the pressed bodies showed strong anisotropy, giving rise to the curve of FIG. 1 (*b*). A high residual magnetic flux density of 9.16 kG was obtained in the press direction. The recrystallization heat-treatment produced a decrease in the coercive force of the pressed bodies, but subsequent aging at 600° C. increased the coercive force to some extent (FIG. 1 (*c*)). The same type of anisotropy induced by heat-treating the pressed bodies was observed in each of the compositions, i.e. Nd-Fe-B, Nd-Fe-B-Cu, Nd-Dy-Fe-B and Nd-Dy-Fe-B-Cu. However, the addition of copper and/or dysprosium produced a particularly marked improvement in the coercive force.

P, which is used as a parameter of the degree of anisotropy, is defined as $$P=(Br(\|)-Br(\perp))/(Br(\|)+Br(\perp))$$

where Br( || ) is residual magnetic flux density in the press direction and Br(⊥) is residual magnetic flux density perpendicular to the press direction. P=0 indicates perfect isotropy and P=1 indicates perfect anisotropy. After pressing (FIG. 1 (*a*)), P 0.04; after heat-treatment (FIG. 1 (*b*)), P=0.37, and after aging (FIG. 1 (*c*)), P=0.35. An anisotropy of P=0.1 or more can be readily achieved by recrystallization heat-treatment of the hot-pressed bodies.

Figure 2A:
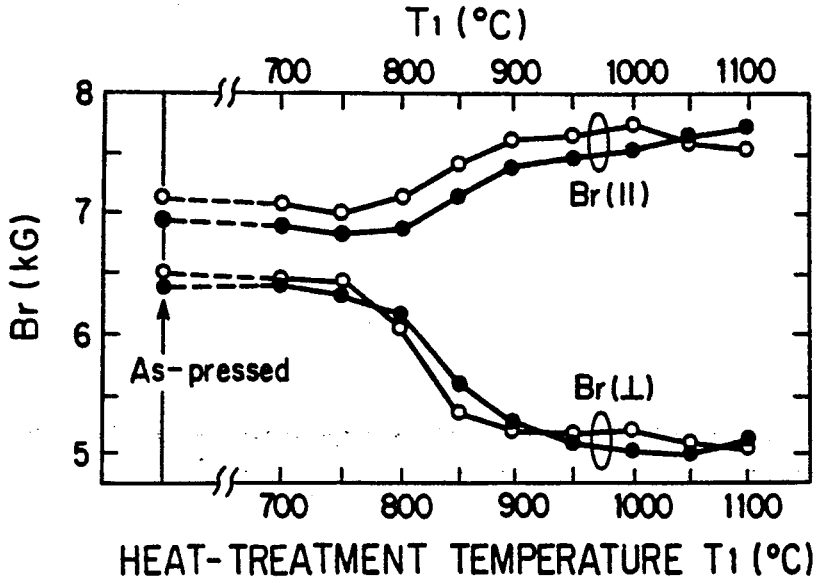
FIGS. 2(*a*) and 2(*b*) show changes in magnetic properties as a function of heat-treatment temperature.
Figure 2B:
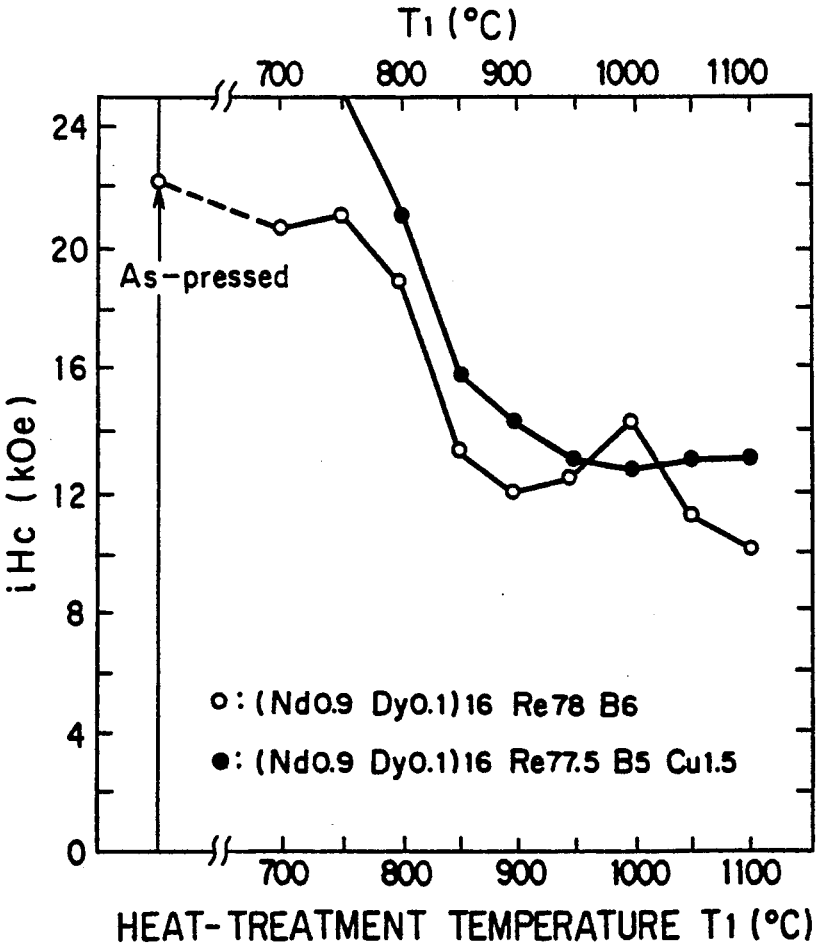
Figure 3A:
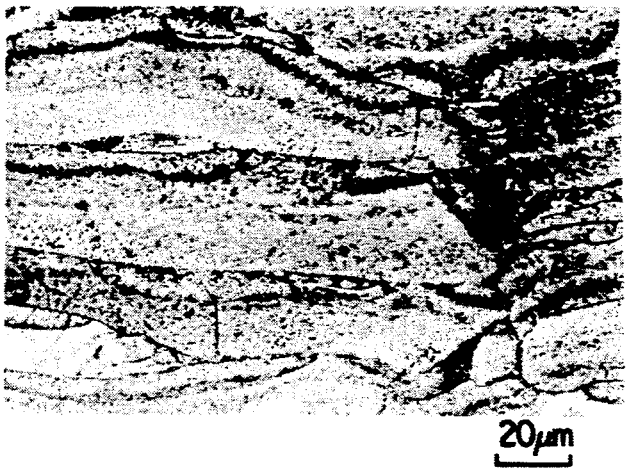
FIGS. 3(*a*) to 3(*c*) show optical micrographs of cross-sections of hot-pressed bodies, (a) prior to heat-treatment, (b) after heat-treatment at 800° C., and (c) after heat-treatment at 1000° C.
Figure 3B:
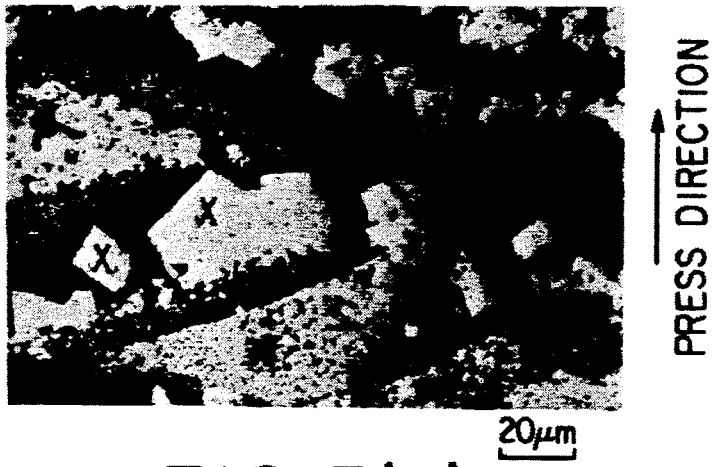
Figure 3C:
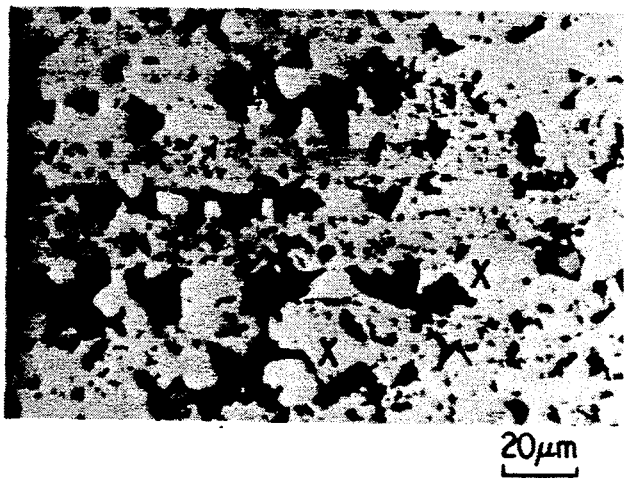

While varying according to the composition, there is marked recrystallization when the pressed bodies are heated at over 750° C. FIG. 2 shows changes in residual magnetic flux density and coercive force in hot-pressed bodies when the temperature is gradually raised, starting at 700° C. In this example the Br( || ) and Br(⊥) curves start to diverge at 800° C., and this difference increases with the increase in temperature. At around 1000° C. the effect reaches the saturation point, and is maintained up to the melting point of 1150° C. FIG. 3 (*a*) is a micrograph of the structure of $(Nd_{0.9}Dy_{0.1})_{1.6}Fe_{78}B_6$ powder that has just been hot-pressed. FIG. 3 (*b*) and 3 (*c*) are micrographs of the structure after the material has been maintained at a temperature of 800° C. and 1000° C., respectively. FIG. 3 (*b*) shows that large recrystallization grains measuring 1 to 100 μm have been produced. These recrystallization grains are $R_2Fe_{14}B$ intermetalic compounds with the same tetragonal structure as the fine grains that existed prior to the heat-treatment. Anisotropy is induced in the pressed bodies by the fact that the easy magnetization axis of recrystallization grains tends to be oriented in the press direction (see FIG. 8). To obtain magnets with a sufficiently high degree of anisotropy, recrystallization grains with an average size of 1 to 100 μm have to account for 50 to 100 vol % of a pressed body. This percentage value can be obtained by measuring the percentage of the area of a micrograph of the recrystallization grain structure, such as the one shown in FIG. 3 (*c*), accounted for by recrystallization grains, and converting the value to vol. %.

Figure 4:
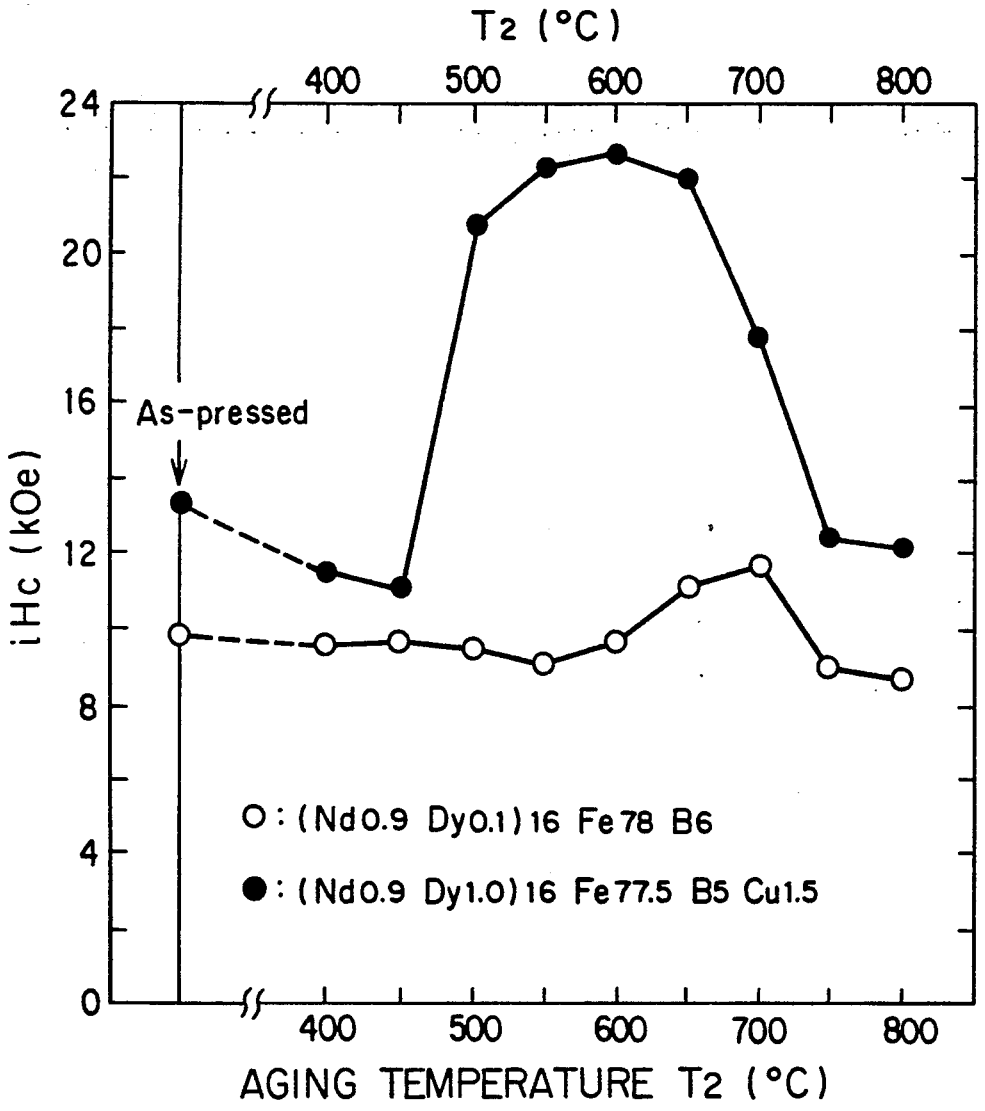
FIG. 4 shows changes in coercive force as a function of aging temperature.

Preferably the recrystallization heat-treatment lasts from 1 to 1000 minutes. Heat-treatment lasting longer than 1000 minutes is unlikely to improve the anisotropy. The coercive force is reduced by the recrystallization heat-treatment, but subsequent aging can produce some recovery. As shown by FIG. 4, aging at 450° C. to 750° C. provides a sufficiently high coercive force particularly when the composition includes additive copper. The preferred aging temperature is 500° C. to 700° C., and a period of 1 to 100 minutes is enough.

The rare earth magnet material according to the present invention has the component elements and amounts of such component elements as described below.

The composition of the rare earths R is not specified, but to obtain good magnetic properties it is preferable that neodymium and/or praseodymium constitute at least 60% of the total rare earth amount. With a basic principle of the present invention being the use of heat-treatment to induce anisotropy and to ensure that this results in magnets with good properties, a rare earth content of 12 to 20 at % is required. With a rare earth content below 12 at % the coercive force will be too low, while if the rare earth content exceeds 20 at % there will be a significant decrease in the residual magnetic flux density. Using dysprosium to constitute up to 20 at % of the R total is an effective way of improving coercive force. If the dysprosium content exceeds 20 at % there will be a significant decrease in the residual magnetic flux density.

A copper content of up to 5 at % is effective for increasing the coercive force of magnets in which anisotropy has been induced by heat-treatment according to the present invention. Adding more than 5 at % copper decreases the degree of anisotropy induced by the recrystallization heat-treatment, resulting in a significant decrease in residual magnetic flux density. Adding both copper and dysprosium is an effective way of increasing the coercive force while minimizing the decrease in the residual magnetic flux density.

A boron content below 2 at % gives rise to excessive $R_2Fe_{17}$ phase, while a content that exceeds 10 at % produces an excessive boron-rich phase. Each such phase impedes the densification of the powder by hot-pressing, hence a boron content of from 2 to 10 at % is specified.

Cobalt may be substituted for some of the iron to raise the Curie point of the alloy and reduce the decrease in magnetic flux density with increasing temperature. In the magnets of this invention, cobalt can constitute up to 40% of the transitional metallic elements (TM) (i.e.

TM=$Fe_{1-x}Co_x$ ($0 \leqq x \leqq 0.4$)). More than 40% cobalt will decrease the coercive force.

The alloy powder thus constituted is produced using a rapid-quenching technique which will now be described. The alloy having the above composition is melted and processed into ribbons by a conventional single-roll technique. Other techniques that may be used for this include the twin-roll method and the atomization process. The single-roll method provides ribbons 20 to 30 μm thick, 1.5 to 2 mm wide and 10 to 20 mm long. The magnetic properties of the ribbons depends on the cooling rate, which is a function of the roll speed. Ribbons produced under optimum rapid-quenching conditions will have fine grains, measuring 0.01 to 0.1 μm, and excellent magnetic properties. Very rapid quenching will result in ribbons with an amorphous-like structure; such ribbons exhibit good magnetic properties when subjected to heat-treatment to produce crystallization. In both cases the ribbons are ground into powder; a particle size of 10 to 500 μm is ideal. Particles smaller than 10 μm are prone to oxidization, and the heat-treatment induces a lower degree of anisotropy (see Example 5). On the other hand, when the particles are larger than 500 μm it becomes difficult to pack the powder into the die cavity for the hot-pressing.

Hot-pressing is performed at a temperature from 500° C. to 900° C. and a pressure of 0.1 to 5 ton/cm$^2$. This is easily achieved with a conventional hot-press machine that uses high-frequency induction heating. Productivity can be improved by using an electrosintering machine which heats by passing a current through the powder under pressure. The rapid heating makes it possible to complete the hot-pressing within about 1 to 5 minutes.

The optimum temperature to carry out recrystallization heat-treatment of a pressed body is 750° C. or higher. The usual heating rate used to achieve this temperature is 0.1° to 100° C./min, and once reached the temperature is maintained for a period ranging from 1 to 1000 minutes. The optimum aging temperature for inducing high coercive force is 450° C. or higher, using a heating rate of 1° to 100° C./min, and the target temperature is maintained for a period of 1 to 100 minutes. The two types of heat-treatment are carried out in an ordinary heat-treatment furnace in a vacuum or an inert atmosphere of argon, for example. These heat-treatments give rise to virtually no shape deformation of the pressed bodies, virtually eliminating any need for grinding and other post-machining of magnets to ensure the correct product shape.

The properties of the anisotropic rare earth magnets of this invention rival those of Sm-Co sintered magnets formed by parallel-field pressing. The magnets of the present invention can be provided at a low cost owing to the low cost of the neodymium, the main rare earth material used, and to the fact that only heat-treatment is used to induce anisotropy. The heat-treatment used to induce the anisotropy leaves the shape of the magnets almost entirely unchanged, so the shape of the magnet remains very close to the shape of the die cavity used in the hot-pressing. In terms of cost this places the magnets of this invention in an advantageous position relative to Nd-Fe-B magnets formed by sintering under atmospheric pressure and requiring post-machining steps such as grinding. The combination of low cost and high performance of the magnets according to this invention is expected to lead to their widespread use as actuators in small motors and other such applications.

EXAMPLE 1

High-frequency induction heating was used to prepare a melt of an alloy having the composition, in atomic percent, of 77.5% Fe−16% Nd−5% B−1.5% Cu ($Nd_{16}Fe_{77.5}B_5Cu_{1.5}$). The melt was ejected onto the peripheral surface of a copper roll rotating at a surface velocity of 25 m/s using a quartz nozzle with an orifice diameter of 1 mm, forming optimum cooling conditions for obtaining a fine-grained structure. This produced ribbons of material 20 to 30 μm thick, about 1.5 mm wide and 10 to 20 mm long. These ribbons were ground into powder with a particle size not exceeding 355 μm.

The powder obtained by the above process was hot-pressed, using an electrosintering machine. In this experiment the powder was placed in the cavity of a carbon die and heated by passing an electric current of about 1500 A through the powder under a pressure of 400 kg/cm$^2$. A cylindrical cavity with a diameter of 20 mm was used. At the point when the measured temperature of the sample under this pressure reached about 800° C., the density of the powder had risen to 7.5 g/cm$^2$, which is near the full density of the alloy. From the start of the heating to the completion of sintering took about 2 to 3 minutes. The pressed bodies thus obtained were heat-treated, magnetized in a pulse magnetic field of 60 kOe and then an automatic-recording fluxmeter was used to measure the magnetic properties.

FIG. 1 (*a*) shows demagnetization curves of the pressed bodies prior to heat-treatment. Recrystallization heat-treatment consisted of rapidly heating the pressed bodies to 600° C. (this heating rate has little effect on properties), then heating at the rate of 0.5° C./min from 600° C. to 1000° C. and maintaining the samples at that temperature for 10 minutes. FIG. 1 (*b*) shows demagnetization curves of the pressed bodies thus heat-treated, and FIG. 1 (*c*) shows demagnetization curves of heattreated pressed bodies which were further subjected to aging at 600° C. for 10 minutes. In each case the curves show demagnetization in the press direction (||) and perpendicular to the press direction (⊥). Anisotropy is P =0.04 in FIG. 1 (*a*), P=0.37 in FIG. 1 (*b*), i.e., after recrystallization heat-treatment, and P=0.35 in FIG. 1 (*c*), i.e. after aging. Magnetic properties in the press direction after aging were Br=9.16 kG, iHc=9.0 kOe and (BH)max=17.6 MGOe.

EXAMPLE 2

The relationship between changes in magnetic properties and heat-treatment temperature was measured in respect of compositions in which dysprosium was substituted for 10% of the neodymium to form $(Nd_{0.9}Dy_{0.1})_{16}Fe_{78}B_6$ and $(Nd_{0.9}Dy_{0.1})_{16}Fe_{77.5}B_5Cu_{1.5}$. The same procedure used in the first example was used to prepare and hot-press rapid-quenched powder of the above composition. The pressed bodies thus obtained were heat-treated for 10 minutes at temperatures rising in stages from 700° C. to 1100° C., and magnetic properties were measured at room temperature following the heat-treatment at each temperature. A heating rate of 60° C./min was used.

The curves of FIG. 2 show residual magnetic flux density parallel to the press direction Br(||) and perpendicular to the press direction Br(195), and coercive force iHc in the press direction. It can be seen that the heat-treatment induces pronounced anisotropy, with the Br(||) and Br(⊥) values starting to diverge at 800°

C. and this difference increasing with further rises in temperature, indicating the large degree of anisotropy induced by this heat-treatment. The degree of anisotropy P, which stood at 0.04 to 0.05 prior to the heat-treatment, rose to over 0.1 at 850° C. and reached a maximum of 0.20 to 0.21. Between 800° C. to 850° C. coercive force showed a rapid fall-off, but at temperatures beyond that point reminded at relatively steady 10 to 14 kOe.

FIG. 3 shows optical micrographs of etched sections of $(Nd_{0.9}Dy_{0.1})_{16}Fe_{78}BN_6$ hot-pressed body samples viewed transverse to the press direction, prior to heat-treatment (FIG. 3 (*a*)), after 10 minutes of heat-treatment at 800° C. (FIG. 3 (*b*)) and after 10 minutes of heat-treatment at 1000° C. (FIG. 3 (*c*)). As shown in FIG. 3 (*b*), fresh grain of $R_2Fe_{14}B$ appeared (some typical such grains are marked with an x), with prominent facets. In FIG. 3 (*c*) virtually the whole of the pressed bodies are comprised of recrystallization grains. Anisotropy is induced in the pressed bodies by the fact that the easy magnetization axis of recrystallization grains tends to be oriented in the press direction.

After the pressed bodies having the above two compositions had been given recrystallization heat-treatment at 1000° C. for 10 minutes, they were rapid-quenched to room temperature and were subjected to aging for 10 minutes at temperatures ranging from 400° C. to 800° C. FIG. 4 shows the coercive force (iHc) in the press direction, measured after aging at each temperature. Samples with copper added and aged at 500° C. to 700° C. showed a marked increase in coercive force.

EXAMPLE 3

The effect of heating rate in recrystallization heat-treatment was investigated. The alloy composition was $(Nd_{0.9}Dy_{0.1})_{16}Fe_{77.5}B_5Cu_{1.5}$m dysprosium being substituted for 10% of the neodymium. The same procedure used in the first example was used to prepare and hot-press rapid-quenched powder of the above composition. The pressed bodies thus obtained were heated to 1000° C. at a rate of 0.5° C. to 60° C./min, and after being maintained at that temperature for 10 minutes were cooled down and the magnetic properties were measured at room temperature.

Figure 5:
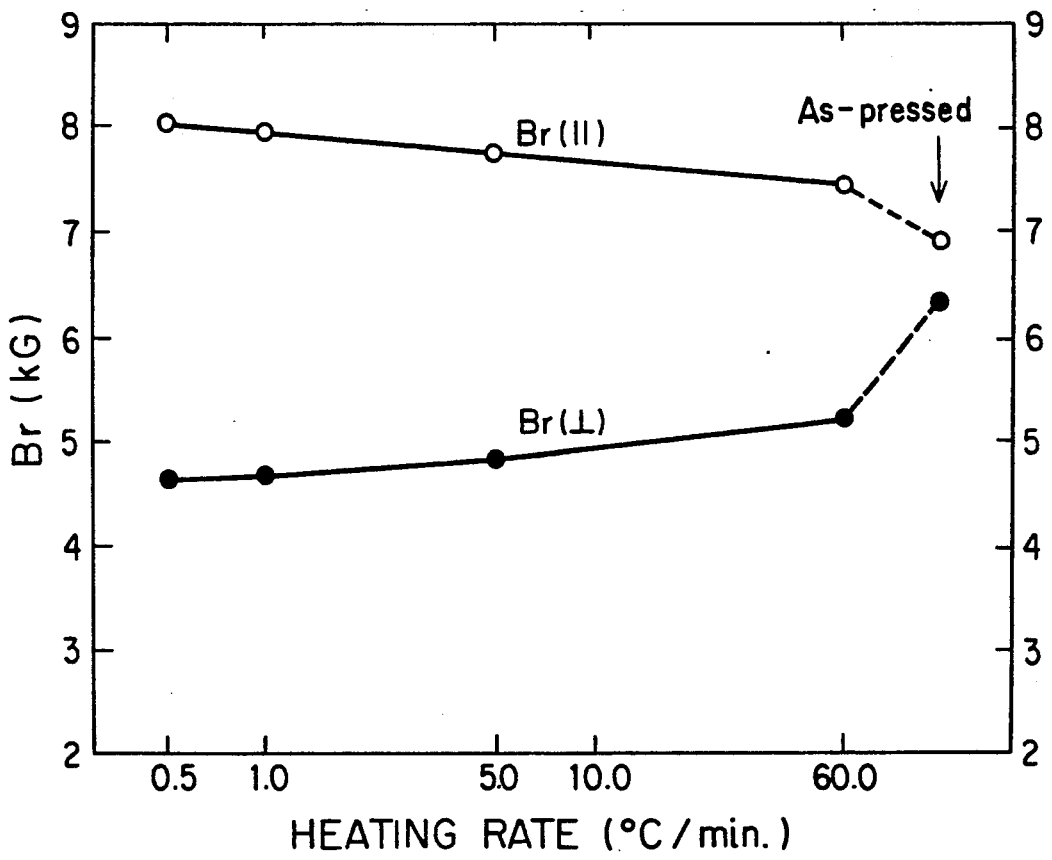
FIG. 5 shows the relationship between residual magnetic flux density and heating rate in recrystallization heat-treatment up to 1000° C.

FIG. 5 shows residual magnetic flux density Br(||) and Br(⊥) values plotted against the heating rate. As can be seen, at slower heating rates there is a larger difference between the Br(||) and Br(⊥) values, indicating a larger degree of anisotropy.

EXAMPLE 4

Hot-pressed bodies were prepared from rapid-quenched powder of $Nd_{16}Fe_{78}B_6$ and $Nd_{16}Fe_{79-x}B_5Cu_x$ (x'1.5, 3.0, 4.5, 6.0) with different amounts of copper. These bodies were subjected to the same recrystallization heat-treatment and aging applied in the first example.

Figure 6A:
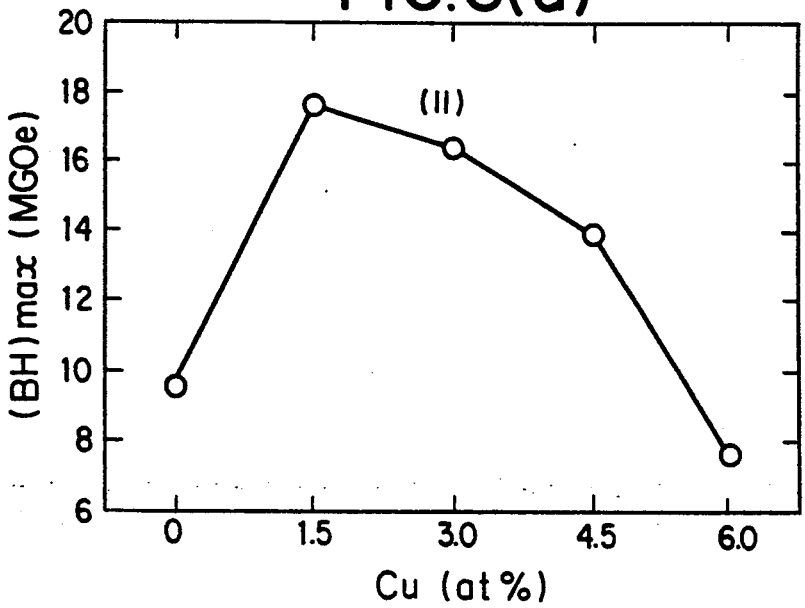
FIG. 6(*a*) to 6(*c*) show the relationship between magnetic properties and the amount of added copper.
Figure 6B:
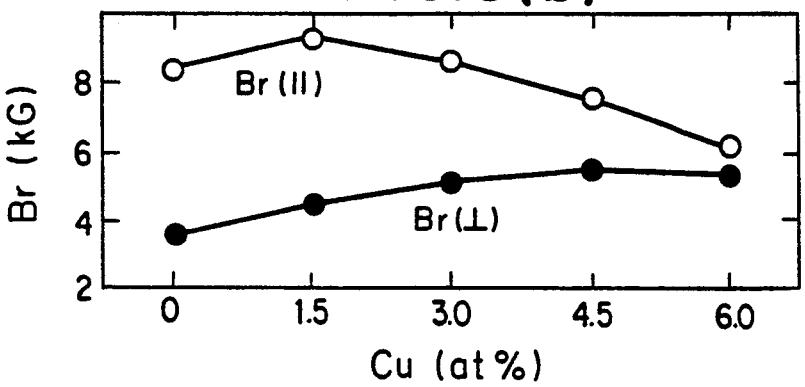
Figure 6C:
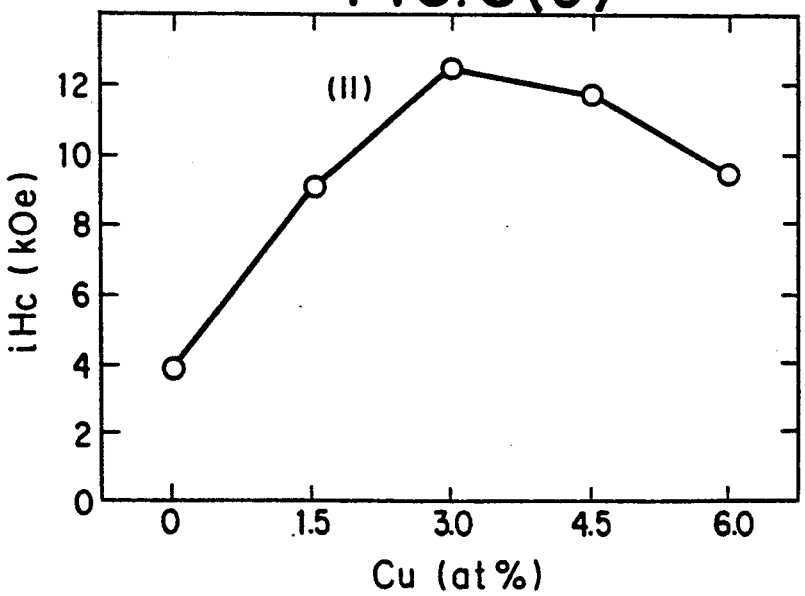

FIG. 6 shows the relationship between copper content and the magnetic properties of pressed body samples which had been heat-treated, including aging. The addition of 1.5 to 4.5% copper produced an improvement in the coercive force. The addition 6% copper caused a drop in the absolute value of the residual magnetic flux density and a reduction in the anisotropy. Anisotropy P was 0.39, 0.35, 0.25, 0.15, and 0.06 for copper contents of 0%, 1.5%, 3.0%, 4.5%, and 6.0%, respectively.

EXAMPLE 5

The effect of recrystallization heat-treatment was investigated with respect to $(Nd_{0.95}Dy_{0.05})_{16}Fe_{77.5}B_5Cu_{1.5}$ in which Dy was substituted for 5% of the Nd. The same procedure used in the first example was used to prepare and hot-press rapid-quenched ribbon material having the above composition. The ribbon was then ground to obtain a powder with an average particle size of 200 μm. Finer powder with a particle size of 5 μm was also prepared for purposes of comparison. These powders were then hot-pressed under the same conditions as in the first example and were subjected to the same recrystallization heat-treatment and aging processes.

Figure 7:
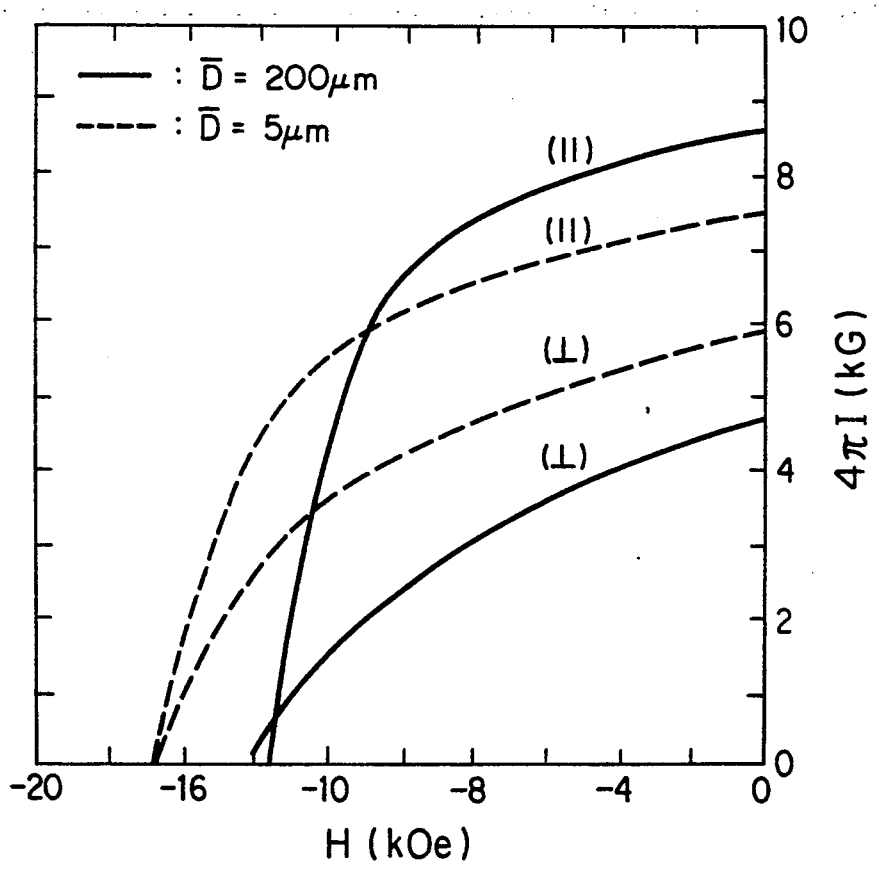
FIG. 7 shows demagnetization curves following heat-treatment and aging for the magnets made from powder particles of different sizes.

FIG. 7 shows demagnetization curves in the press direction (||.) and perpendicular to the press direction (⊥). It can be seen that samples made of the 200 μm powder are highly anisotropic, while those made of 5 μm powder exhibit low anisotropy.

FIG. 8 shows x-ray diffraction intensity profiles of pressed bodies formed of 200 μm powder. These profiles were obtained with CuKα radiation incident on the sample plane perpendicular to the press direction. FIG. 8 (*a*) is the profile prior to the recrystallization heat-treatment, and FIG. 8 (*b*) is the profile of heat-treated samples. Substantially all the peaks in the profiles were indexed as crystal planes of the $R_2Fe_{14}B$ tetragonal intermetallic compound. The relative intensity of the 006 reflection of the heat-treated sample is much greater than that of the non-heat-treated sample, confirming that the heat-treatment induced an increase in the orientation of the easy magnetization axis (c-axis) of the grains in the press direction. This demonstrates that recrystallization heat-treatment induces anisotropy.

EXAMPLE 6

Hot-pressed bodies were formed from rapid-quenched powder of the various compositions and were subjected to the same recrystallization heat-treatment and aging processes described with reference to the first example. The compositions of the powder and the magnetic properties (iHc, Br(||), Br(⊥), and anisotropy P) of aged samples are set out in Table 1. These figures show that recrystallization heat-treatment also induces anisotropy in alloys containing cobalt and alloys containing praseodymium as the rare earth element.

TABLE I

| Composition | iHc/kOe | Br(\|\|)/kG | Br(⊥)/kG | P |
|---|---|---|---|---|
| $Nd_{16}Fe_{77.5}B_5Cu_{1.5}$ | 9.0 | 9.16 | 4.44 | 0.35 |
| $Pr_{16}Fe_{77.5}B_5Cu_{1.5}$ | 9.6 | 8.10 | 4.80 | 0.26 |
| $(Nd_{0.9}Dy_{0.1})_{16}Fe_{77.5}B_5Cu_{1.5}$ | 19.0 | 8.01 | 4.90 | 0.24 |
| $(Nd_{0.9}Dy_{0.1})_{16}(Fe_{0.8}Co_{0.2})_{77.5}B_5Cu_{1.5}$ | 13.8 | 7.73 | 4.93 | 0.22 |

We claim:

1. A method of producing an anisotropic rare earth magnet, comprising the steps of:

rapidly quenching a melt and forming an alloy powder consisting essentially of 12 to 20 at % R (where R denotes rare earth elements including at least one member selected from the group consisting of neodymium and praseodymium), 2 to 10 at % boron, up to 5 at % copper, with the remainder being TM (where $TM=Fe_{1-x}Co_x$ ($0 \leqq x \leqq 0.4$)) and unavoidable impurities;

hot-pressing the alloy powder to form a pressed body by consolidating the powder to 90% or more of the full density of the alloy powder;

recrystallization heat treating the pressed body at 750°-1150° C.; and aging the pressed body at 450°-750° C.;

wherein the resultant anisotropic rare earth magnet has recrystallization grains of $R_2Fe_{14}B$ intermetallic compound having a tetragonal crystal structure with an average grain size of 1 to 100 μm and an induced anisotropy P of 0.1 or more where $P=(Br(\|)-Br(\perp))/(Br(\|)+Br(\perp))$, $Br(\|)$ being residual magnetic flux density along the easy magnetization axis and $Br(\perp)$ being residual magnetic flux density perpendicular to the easy magnetization axis.

2. The method according to claim 1, wherein up to 20 at % of the total R amount is dysprosium.

3. The method according to claim 1 in which hot-pressing is effected by passing an electric current through the powder under pressure.

4. The method according to claim 2 in which hot-pressing is effected by passing an electric current through the powder under pressure.

* * * * *